US008207787B2

(12) United States Patent
Hasegawa et al.

(10) Patent No.: US 8,207,787 B2
(45) Date of Patent: Jun. 26, 2012

(54) LOW-VOLTAGE OPERATION CONSTANT-VOLTAGE CIRCUIT

(75) Inventors: Kazuo Hasegawa, Oizumi-Machi (JP); Hirohisa Suzuki, Oizumi-Machi (JP)

(73) Assignee: Semiconductor Components Industries, LLC, Phoenix, AZ (US)

( * ) Notice: Subject to any disclaimer, the term of this patent is extended or adjusted under 35 U.S.C. 154(b) by 0 days.

(21) Appl. No.: 12/540,940

(22) Filed: Aug. 13, 2009

(65) Prior Publication Data

US 2010/0045367 A1 Feb. 25, 2010

(30) Foreign Application Priority Data

Aug. 20, 2008 (JP) ..... 2008-212155
Aug. 20, 2008 (JP) ..... 2008-212157

(51) Int. Cl.
*G05F 3/26* (2006.01)
*G05F 1/567* (2006.01)

(52) U.S. Cl. ..... 327/543; 327/541; 327/539; 323/316

(58) Field of Classification Search ..... None
See application file for complete search history.

(56) References Cited

U.S. PATENT DOCUMENTS

| | | | | |
|---|---|---|---|---|
| 5,900,773 | A * | 5/1999 | Susak | 327/539 |
| 6,150,872 | A * | 11/2000 | McNeill et al. | 327/539 |
| 6,563,295 | B2 * | 5/2003 | Juang | 323/315 |
| 6,933,769 | B2 * | 8/2005 | Koelling | 327/538 |
| 7,034,514 | B2 * | 4/2006 | Tachibana et al. | 323/313 |
| 2008/0094130 | A1 * | 4/2008 | Uang et al. | 327/539 |

* cited by examiner

*Primary Examiner* — Lincoln Donovan
*Assistant Examiner* — Terry L Englund
(74) *Attorney, Agent, or Firm* — Westerman, Hattori, Daniels & Adrian, LLP

(57) ABSTRACT

According to a preferred embodiment of the present invention, a low-voltage operation constant-voltage circuit includes a band-gap reference voltage circuit including a resistor-diode series circuit as a main component. A resistor and a diode-connected bipolar transistor are connected in series to create a constant current. It also includes an output circuit connected in parallel to the resistor-diode series circuit and formed so that the same constant current as the current flowing through the resistor-diode series circuit flows. The output circuit includes a diode-connected MOS transistor, and is configured to cancel the positive temperature coefficient of the current flowing through the output circuit by the MOS transistor. With this, a stable output low-voltage of, e.g., about 0.6 V, excellent in temperature characteristics can be obtained regardless of the ambient temperature changes.

3 Claims, 12 Drawing Sheets

LOW-VOLTAGE OPERATION CONSTANT-VOLTAGE CIRCUIT

This application claims priority under 35 U.S.C. §119 to Japanese Patent Application No. 2008-212155 filed on Aug. 20, 2008 and No. 2008-212157 filed on Aug. 20, 2008, the entire disclosure of each of which is incorporated herein by reference in its entirety.

BACKGROUND OF THE INVENTION

1. Field of the Invention

The present invention, inter alia, relates to a low-voltage operation constant-voltage circuit. More specifically, it relates to a low-voltage operation constant-voltage circuit excellent in temperature characteristics and capable of being operated at a relatively low power supply voltage, such as, e.g., at about 1 V, and obtaining a stable output voltage, such as, e.g., about 0.6 V, regardless of the ambient temperature changes.

2. Description of the Related Art

The following description describes the knowledge of the inventor regarding the related art and the problems and therefore should not be interpreted that the inventor acknowledges them as prior art.

In the recent years, there exist many products configured to be operated at a relatively low-voltage to reduce the size and weight. In these types of products, a reference voltage which is low in voltage and stable in operation is required to operate the circuit in the product. As a circuit configured to obtain a stable output voltage, conventionally known is a band-gap reference voltage circuit configured to create a constant current source having a positive temperature coefficient and cancel the positive temperature coefficient of the voltage appeared at both ends of a resistance and the negative temperature coefficient of the base-emitter voltage of a diode-connected bipolar transistor (see, e.g., Japanese Patent Publication No. 2,734,964 and Japanese Patent Publication No. 2,745,610).

A conventionally known typical band-gap reference voltage circuit using bipolar transistors is shown in FIG. 12. This reference voltage circuit includes a first transistor Q1 having a unit emitter area, a second transistor Q2 having m-times emitter area ("m" is a positive number) and having an emitter resistance R1, a diode-connected third transistor Q3, a current mirror circuit including a diode-connected fourth transistor Q4 and a fifth transistor Q5 for self-biasing of the transistors Q1 and Q2, and a sixth transistor Q6 having a base to which the collector of the transistor Q5 is connected, wherein the first to third transistors are commonly connected with each other at their bases. This band-gap reference voltage circuit is configured such that the collector of the transistor Q6 drives the transistor Q3 through a resistor R2 to obtain an output voltage $V_{REF}$.

The base-emitter voltage $V_{BE3}$ of the third transistor Q3 has negative temperature characteristics, and the collector current I of the transistor Q3 has positive temperature characteristics, and therefore the temperature characteristics appeared at both ends of the resistor R2 become positive. Therefore, by connecting the resistor R2 and the third transistor Q3 in series, the positive temperature coefficient of the collector current I and the negative temperature coefficient of the base-emitter voltage $V_{BE3}$ are cancelled, causing a stable output voltage regardless of the ambient temperature changes.

However, in the conventional reference voltage circuit, the reference voltage must be equal to the energy band-gap voltage (about 1.2 V) to make the temperature coefficient zero, and therefore only about 1.2 V output voltage can be extracted, and that the power supply voltage must be higher than that voltage (e.g., about 2 V). For this reason, the circuit cannot be operated at a low power supply voltage. Furthermore, the output voltage of the circuit is high, and therefore it could not be used as a reference voltage source for, e.g., a reset circuit for a microcomputer which requires a low reference voltage, such as, e.g., about 0.6 V.

The description herein of advantages and disadvantages of various features, embodiments, methods, and apparatus disclosed in other publications is in no way intended to limit the present invention. For example, certain features of the preferred embodiments of the invention may be capable of overcoming certain disadvantages and/or providing certain advantages, such as, e.g., disadvantages and/or advantages discussed herein, while retaining some or all of the features, embodiments, methods, and apparatus disclosed therein.

SUMMARY OF THE INVENTION

The preferred embodiments of the present invention are based on the above described issues of the related art and/or other issues. The preferred embodiment of the present invention can significantly improve the existing method and/or device.

Among other potential advantages, some embodiments can provide a low-voltage operation constant-voltage circuit excellent in temperature characteristics and capable of being operated at a relatively low power supply voltage, such as, e.g., about 1 V, and obtaining a stable output voltage, such as, e.g., about 0.6 V, regardless of the ambient temperature changes.

According to a first aspect of the present invention, in a low-voltage operation constant-voltage circuit including a band-gap reference voltage circuit as a main structural element, the low-voltage operation constant-voltage circuit is provided with an output circuit in which the same constant current as in the band-gap reference voltage circuit flows, and a diode-connected MOS transistor is employed in the output circuit so that the positive temperature coefficient of the current flowing through the output circuit is cancelled by the MOS transistor.

More specifically, a low-voltage operation constant-voltage circuit includes a band-gap reference voltage circuit having a resistor-diode series circuit as a main structural element in which a resistor and a diode-connected bipolar transistor are connected in series to create a constant current, and an output circuit connected in parallel to the resistor-diode series circuit and configured so that the same constant current as a current flowing through the resistor-diode series circuit flows. The output circuit includes a diode-connected MOS transistor and configured to cancel a positive temperature coefficient of the current flowing through the output circuit by the MOS transistor.

In a more specific embodiment, a low-voltage operation constant-voltage circuit has a band-gap reference voltage circuit including a first series circuit in which a MOS transistor and a diode-connected bipolar transistor are connected in series and a second series circuit in which a MOS transistor, a resistor, a diode-connected bipolar transistor are connected in series. The band-gap reference voltage circuit is configured to compare a collector voltage of the bipolar transistor of the first series circuit and the voltage of one end of the resistor of the second series circuit and control so that a current of the first series circuit and a current of the second series circuit become equal. The low-voltage operation constant-voltage circuit also has an output circuit in which a first MOS transistor and a second diode-connected MOS transistor are connected in series, wherein the output circuit is controlled so that the same constant current as the current flowing through the first series circuit and the current flowing through the second series circuit flows. An output voltage is obtained from a connection point of the first and second MOS transistors.

Any desired temperature coefficient can be obtained by using a diode-connected MOS transistor forming the output circuit by appropriately setting its width W and length L according to its use.

According to the invention described above, a low constant-voltage excellent in temperature characteristics can be obtained by one MOS transistor element. Also, since the same circuit structure as in the band-gap reference constant-voltage circuit is employed as its main structural element, the unevenness in resistance differences and the ratio of dimensions of transistors can be cancelled while keeping the same precision regardless of products, which enables to easily and assuredly obtain a low constant-voltage (for example, around 0.6 V) excellent in temperature characteristics without burdensome adjustments. Furthermore, the size of the circuit can be reduced, and the current consumption can be reduced as well.

Furthermore, according to a second aspect of the present invention, a resistor in which a positive temperature coefficient voltage appears at both ends and a diode-connected bipolar transistor in which the base-emitter voltage has a negative temperature coefficient, which were connected in series in a conventional band-gap reference low-voltage circuit, are separated into first and second series circuits (transistor-resistor series circuit and transistor-diode series circuit). The positive temperature characteristics of the voltages appearing at both ends of the resistor and the negative temperature characteristics of the base-emitter voltage of the diode-connected bipolar transistors are separately extracted, and a midpoint voltage is created by resistors connected in series, and buffered and extracted as an output voltage.

Thus, an output voltage, which was about 1.2 V conventionally, can be reduced by half to about 0.6 V.

Specifically, a low-voltage operation constant-voltage circuit includes a band-gap reference voltage circuit as a main structural element configured to cancel a positive temperature coefficient of a voltage appearing at a resistor and a negative temperature coefficient of a base-emitter voltage of a diode-connected bipolar transistor. The resistor and the diode-connected bipolar transistor are separated into a transistor-resistor series circuit in which a bipolar transistor and a resistor are connected in series and a transistor-diode series circuit in which a bipolar transistor and a diode-connected bipolar transistor are connected in series. In the transistor-resistor series circuit, an emitter of the bipolar transistor is connected to a power supply voltage terminal, a collector thereof is connected to one end of the resistor, and the other end of the resistor is grounded. In the transistor-diode series circuit, an emitter of the bipolar transistor is connected to the power source voltage terminal, the collector thereof is connected to a collector of the diode-connected bipolar transistor, and an emitter of the diode-connected bipolar transistor is grounded. One end of a pair of resistors having the same resistance value and connected in series is connected to a bipolar transistor connection side terminal of the resistor, and the other end of the pair of resistors is connected to a collector side terminal of the diode-connected bipolar transistor. An output voltage is obtained from a connection point of the pair of resistors.

In the aforementioned low-voltage operation constant-voltage circuit, it is preferable that one end of the pair of resistors connected in series is connected to the connection side terminal of the bipolar transistor of the resistor through a first buffer circuit, the other end of the pair of resistors is connected to the collector side terminal of the diode-connected bipolar transistor through the second buffer circuit, and the midpoint voltage extracted from a middle connection point of the pair of resistors is obtained as the output voltage through a third buffer circuit.

The above-described and/or other aspects, characteristics and/or advantages of various embodiments are even clearer when the attached drawings are shown with the following descriptions. When appropriate for various types of embodiments, other different aspects, characteristics and/or advantages can be included and/or excluded. Also, when appropriate for various embodiments, one or a plurality of aspects of other embodiments can be combined. The descriptions for aspects, characteristics and/or advantages of specific embodiments do not limit other embodiments or claims.

BRIEF DESCRIPTION OF THE DRAWINGS

The preferred embodiments of the present invention are shown by way of example, and not limitation, in the accompanying figures, in which.

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

First Embodiment

Figure 1:
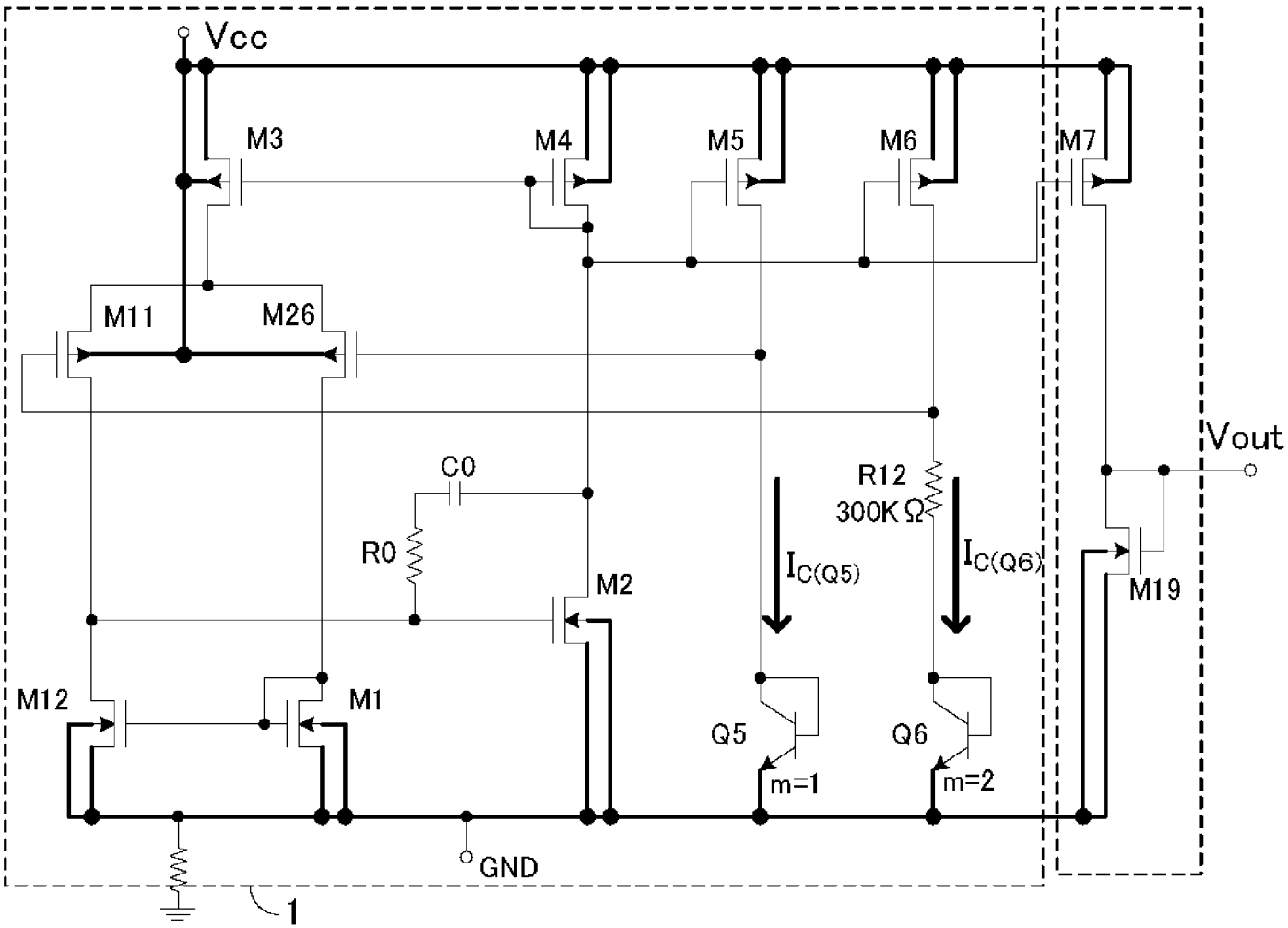
FIG. 1 is a circuit diagram of a low-voltage operation constant-voltage circuit according to a first embodiment of the present invention.

FIG. 1 shows a low-voltage operation constant-voltage circuit according to a first embodiment of the present invention. This constant-voltage circuit is equipped with an operational amplifier (Op-Amp) type band-gap reference voltage circuit, and excellent in temperature characteristic. This constant-voltage circuit is configured to output a stable and low output voltage of, e.g., about 0.6 V from an output terminal $V_{OUT}$ regardless of the ambient temperature changes. Especially, this constant-voltage circuit is suitably used for a constant-voltage power source for minute electric current, such as, e.g., a reference voltage source for a reset circuit of a microcomputer. This constant-voltage circuit includes a differential circuit in which a voltage comparison is performed by MOS transistors M11 and M26 to supply currents from a current mirror circuit constituted by transistors M12 and M1 so that the collector current $I_{C(Q5)}$ of the transistor Q5 and the collector current $I_{C(Q6)}$ of the transistor Q6 become equal.

Figure 5:
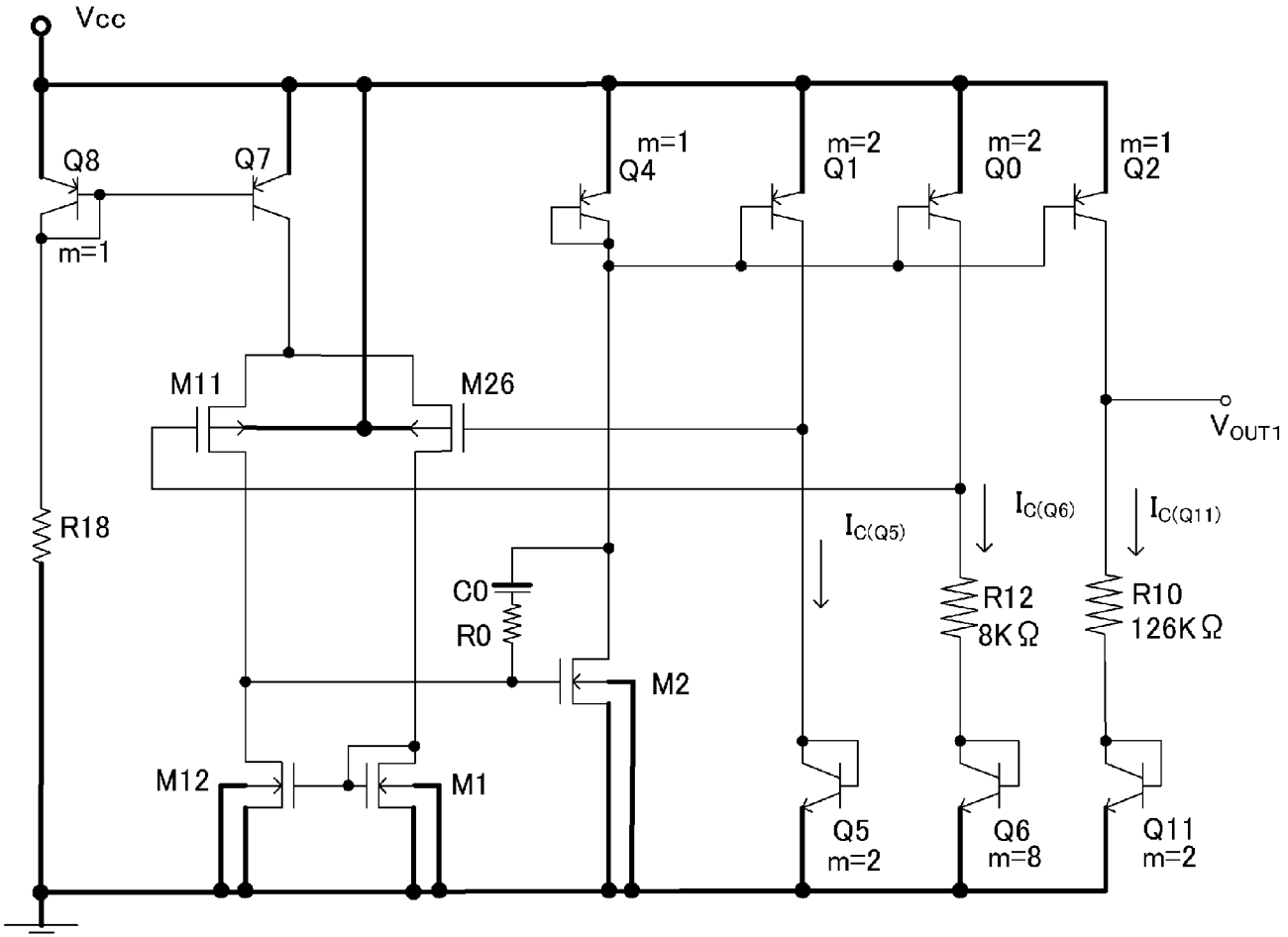
FIG. 5 shows a concrete example of a circuit diagram of another band-gap reference voltage circuit.
Figure 6:
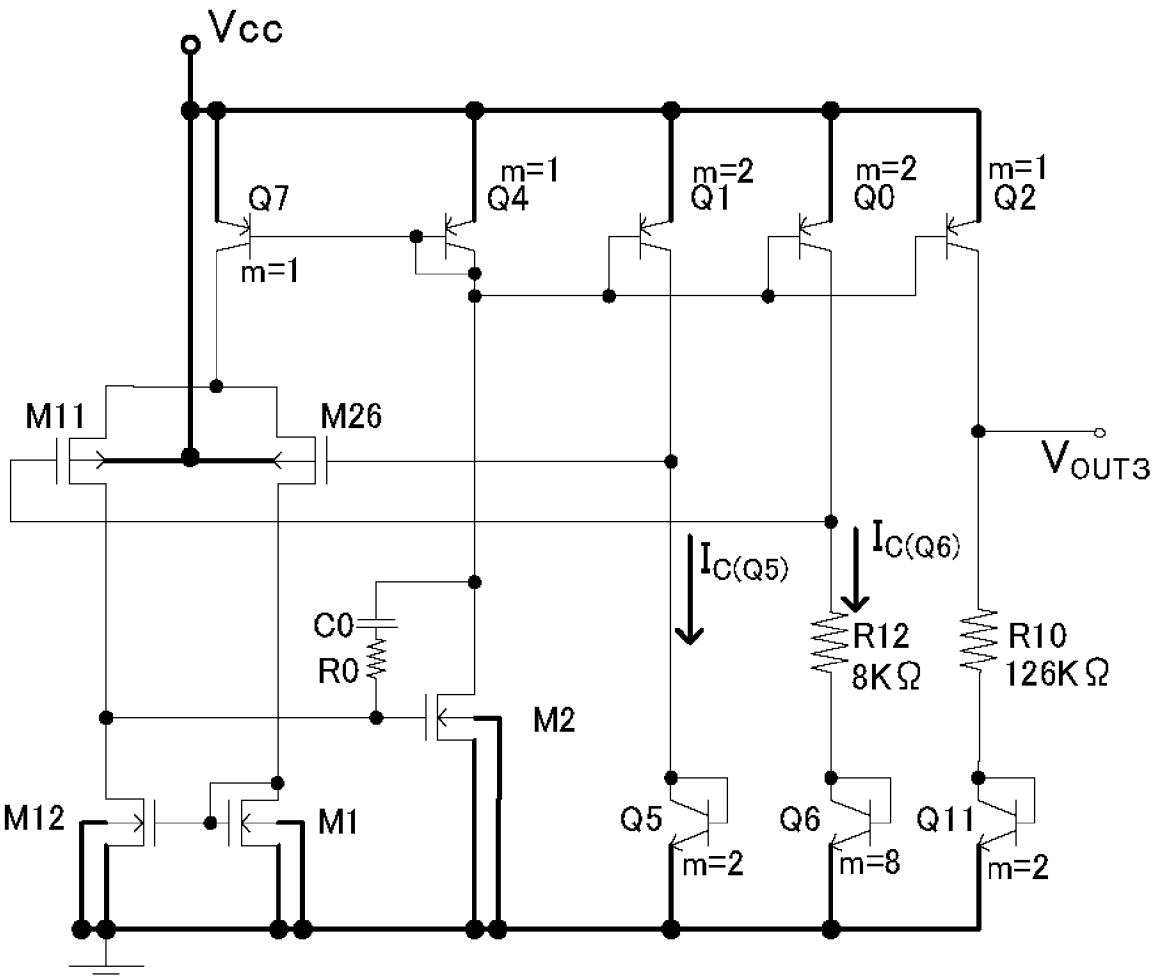
FIG. 6 shows a concrete example of a circuit diagram of still another band-gap reference voltage circuit.
Figure 7:
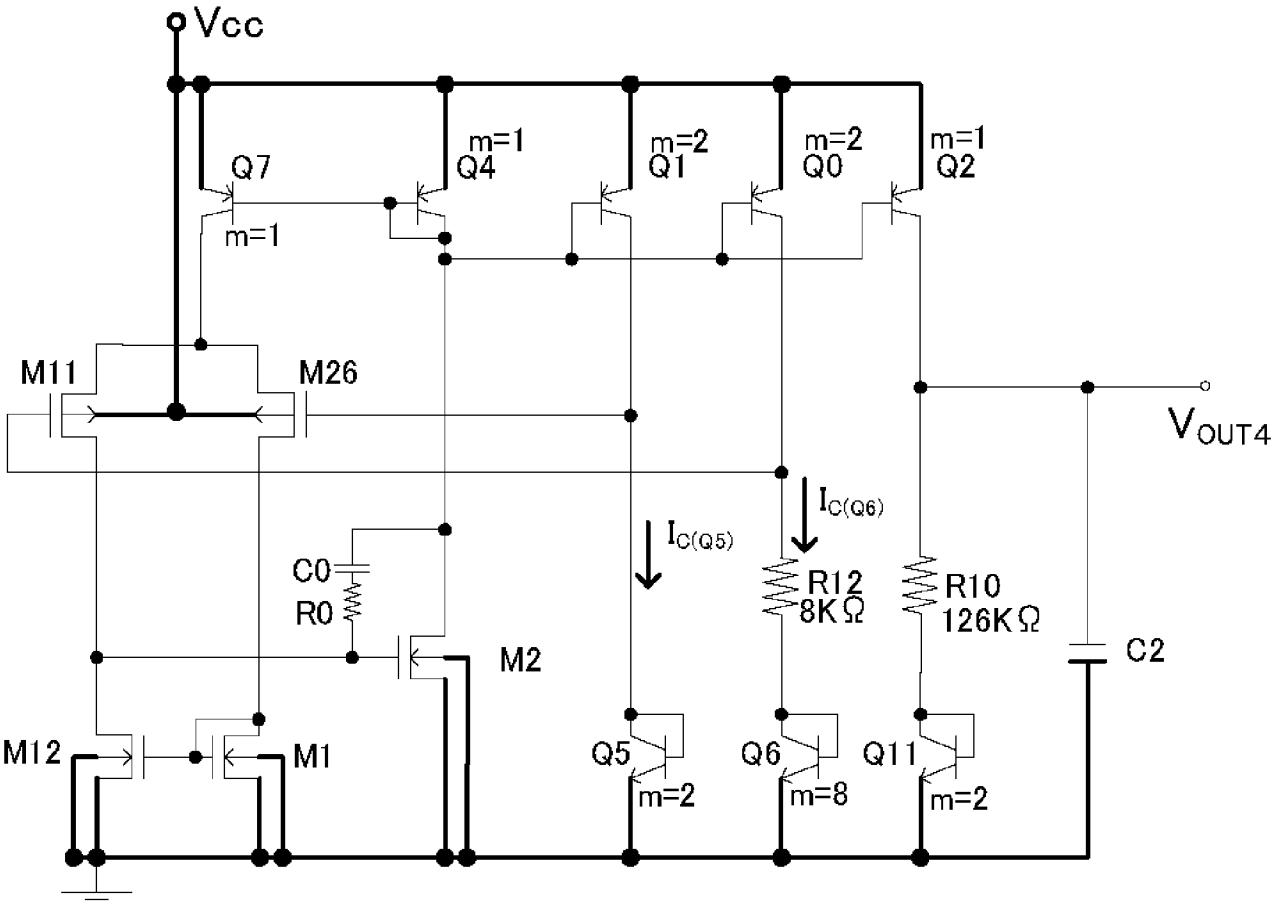
FIG. 7 is a circuit diagram in which a bypass condenser is added to the band-gap reference voltage circuit shown in FIG. 6.

Hereinafter, the low-voltage operation constant-voltage circuit according to this embodiment will be explained in detail. As shown by the portion 1 surrounded by the dashed line in FIG. 1, this low-voltage operation constant-voltage circuit includes a band-gap reference voltage circuit as its main component. It should be noted that, in the low-voltage operation constant-voltage circuit according to the present invention, the specific structure of the band-gap reference constant-voltage circuit portion is not specifically limited, and the circuit can be, for example, a band-gap reference constant-voltage circuit using bipolar transistors as shown in FIG. 3, an Op-Amp type band-gap reference constant-voltage circuit as shown in FIGS. 5 to 7, and any other conventionally known various band-gap reference constant-voltage circuits.

Initially, an improved band-gap reference voltage circuit using bipolar transistors shown in FIG. 3 will be explained. This circuit itself has new structure and produces the following specific functions and effects.

Figure 3:
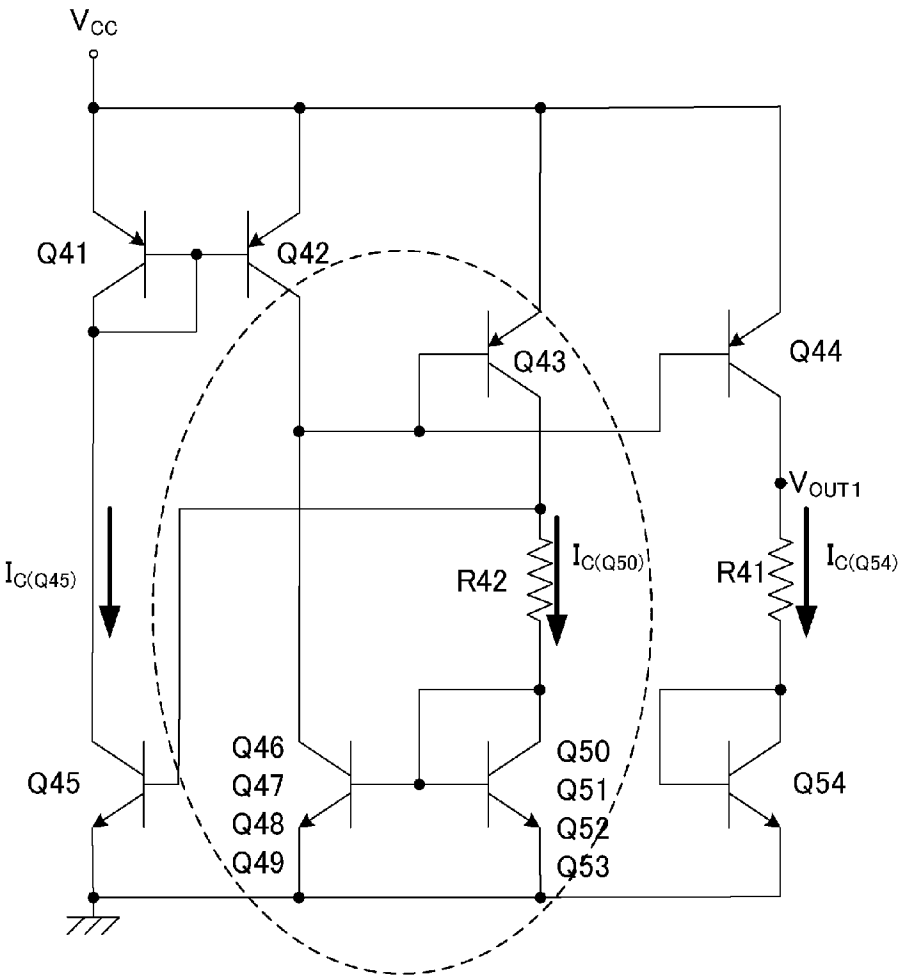
FIG. 3 shows a concrete example of a circuit diagram of an improved band-gap reference voltage circuit.

As shown in FIG. 3, in this circuit, a diode-connected transistor Q41 and a transistor Q45 are connected in series to form a first series circuit. The emitter of the transistor Q41 is connected to the power source voltage Vcc, the collector thereof is connected to the collector of the transistor Q45, and the emitter of the transistor Q45 is grounded.

Also, a transistor Q42 and transistors Q46 to 49 which are connected in parallel with each other are connected in series to form a second series circuit. The emitter of the transistor Q42 is connected to the power source voltage Vcc, the collector thereof is connected to the collectors of the transistors Q46 to 49, and the emitters of the transistors Q46 to 49 are grounded. The transistor Q41 forming the first series circuit and the transistor Q42 forming the second series circuit are connected at their bases with each other to form a current mirror circuit.

Further, a transistor Q43, a resistor R42, and diode-connected transistors Q50 to Q53 are connected in series to form a third series circuit. The emitter of the transistor Q43 is connected to the power source voltage Vcc, the collector thereof is connected to the collectors of the diode-connected transistors Q50 to Q53 through the resistor R42, and the emitters of the transistors Q50 to Q53 are grounded. The base of the transistor Q43 forming the third series circuit is connected to the collector of the transistor Q42 forming the second series circuit. Also, the transistors Q46 to Q49 forming the second series circuit and the transistors Q50 to Q53 forming the third series circuit are connected at their bases with each other to form a current mirror circuit.

Furthermore, one end of the resistor 42 forming the third series circuit (the collector side connection terminal of the transistor Q43) is connected to the base of the transistor Q45 forming the first series circuit. Further, a transistor Q44, a resistor R41, and a diode-connected transistor Q54 are connected in series to form a fourth series circuit. The emitter of the transistor Q44 is connected to the power source voltage Vcc, the collector thereof is connected to one end of the resistor R41, and the other end of the resistor R41 is connected to the collector of the diode-connected transistor Q54. The emitter of the transistor Q54 is grounded. The base of the transistor Q44 is connected to the base of the transistor Q43 of the third series circuit.

In the abovementioned circuit, the collector current $I_{C(Q45)}$ of the transistor Q45 forming the first circuit, the collector current $I_{C(Q50)}$ of the transistors Q50 to Q53 forming the third series circuit, and the collector current $I_{C(Q54)}$ of the transistor Q54 forming the fourth series circuit become equal with each other regardless of the fluctuation of the power source voltage Vcc. In the circuit, the following condition is established and the circuit becomes in a balanced state.

$$I_{C(Q45)}=I_{C(Q50)}=I_{C(Q54)}$$

Therefore, in this circuit, the output voltage $V_{OUT1}$ has a constant-voltage characteristic.

Figure 4:
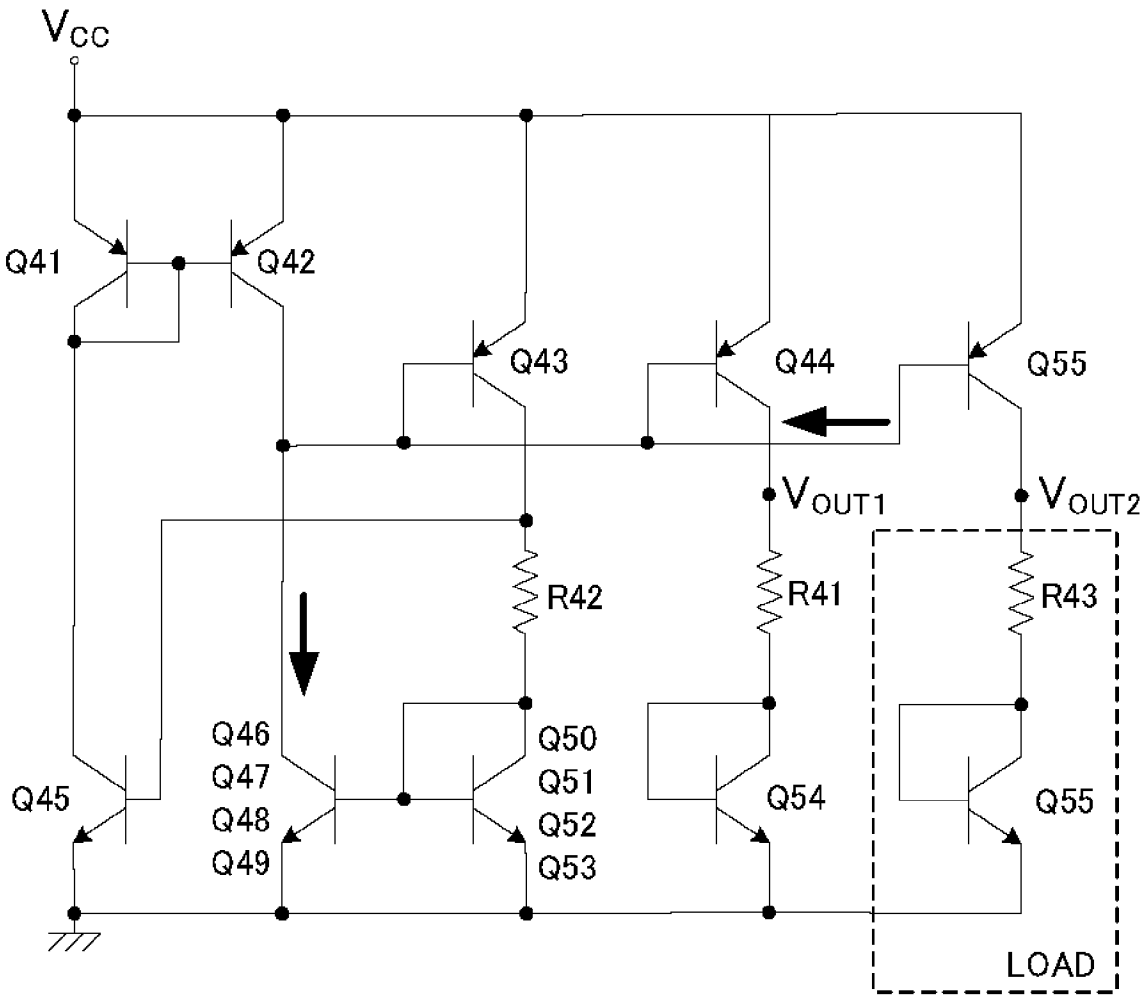
FIG. 4 is a circuit diagram showing a state in which an output system is connected to the improved band-gap reference voltage circuit.

In this state, as shown in FIG. 4, when an output system in which a bipolar transistor Q55, a resistor R43, and a diode-connected bipolar transistor Q55 are connected in series is added to the band-gap reference voltage circuit, as the current of the output system increases, as shown by an arrow, the base current of the transistor Q55 increases corresponding to the 1/hfe times of the increased collector current. In this improved band-gap reference voltage circuit, however, the increased collector current flows through the collectors of transistors Q46 to Q49 forming the second series circuit, having a less influence to the resistor R42 forming the third series circuit, which makes it possible to avoid voltage drop of the output voltages $V_{OUT1}$ and $V_{OUT2}$. In detail, as shown in FIG. 3, the transistors Q46 to Q49 and the transistors Q50 to Q53 form a current mirror circuit so that the operation reference is handled by the transistors Q50 to Q53, the resistor R42 and the transistor Q45 and that the driving of the transistors Q43 and Q44 (and Q55) is handled by the transistors Q46 to Q49 to reduce effects on the next stage series circuit.

As discussed above, in the improved and new band-gap reference voltage circuit shown in FIG. 3, when the collector current of the transistor Q55 to be connected as an output system is considered as a constant current source, the current changes with respect to the changes of load resistances (R43, Q55) decrease. In other words, the constant current characteristics are improved.

The band-gap reference voltage circuit shown in FIG. 5 is an Op-Amp type circuit. This band-gap reference voltage circuit (constant-voltage circuit) includes an amplifier circuit on the left and first to fourth series circuits on the right.

The left portion including the amplifier circuit is constituted by bipolar transistors Q7 and Q8, MOS transistors M11, M26, M12, and M1, and a resistor R18. That is, the diode-connected bipolar transistor Q8 and the resistor 18 are connected in series, the emitter of the transistor Q8 is connected to the power source voltage terminal Vcc, and the collector thereof is connected to one end of the resistor R18. The other end of the resistor R18 is grounded. Also, the emitter of the transistor Q7 connected to the diode-connected transistor Q8 at their bases to form a current mirror circuit is connected to the power source voltage terminal Vcc, and the collector thereof is connected to the sources of the MOS transistors M11 and M26. The drains of the MOS transistors M11 and M26 are connected to the drains of the MOS transistor M12 and diode-connected MOS transistor M1. These MOS transistors M12 and M1 are connected at their bases to form a current mirror circuit. The sources of the MOS transistor M12 and M1 are grounded.

The first series circuit is formed by connecting a diode-connected bipolar transistor Q4 and a MOS transistor M2 in series. The emitter of the diode-connected bipolar transistor Q4 is connected to the power source voltage terminal Vcc, the collector thereof is connected to the drain of the MOS transistor M2, and the source of the MOS transistor M2 is grounded. The drain and the gate of the MOS transistor M2 are connected via a resistor R0 and a condenser C0, and the gate thereof is connected to the drain of the MOS transistor M12 of the amplifier circuit.

The second series circuit is formed by connecting a bipolar transistor Q1 and a diode-connected bipolar transistor Q5 in series. The emitter of the bipolar transistor Q1 is connected to the power source voltage terminal Vcc, and the collector thereof is connected to the collector of the diode-connected bipolar transistor Q5. The emitter of the transistor Q5 is grounded. The collector of the bipolar transistor Q1 is connected to the gate of the MOS transistor M26 of the amplifier circuit.

The third series circuit is formed by connecting a bipolar transistor Q0, a resistor R12, and a diode-connected bipolar transistor Q6 in series. The emitter of the bipolar transistor Q0 is connected to the power source voltage terminal Vcc, and the collector thereof is connected to one end of the resistor R12. The other end of the resistor R12 is connected to the collector of the diode-connected bipolar transistor Q6, and the emitter of the transistor Q6 is grounded. The collector of the bipolar transistor Q0 is connected to the gate of the MOS transistor M11 of the amplifier circuit.

The fourth series circuit is formed by connecting a bipolar transistor Q2, a resistor R10, and a diode-connected bipolar transistor Q11 in series. The emitter of the bipolar transistor Q2 is connected to the power source voltage terminal Vcc, and the collector thereof is connected to one end of the resistor R10 (the upper end of the resistor in FIG. 5), and the other end of the resistor R10 is connected to the collector of the bipolar transistor Q11. The emitter of the transistor Q11 is grounded.

The bipolar transistors Q4, Q1, Q0, and Q2 forming the first to fourth series circuits respectively are commonly connected at their bases. In the drawings, "m" denotes the number of transistors connected in parallel.

In this embodiment, the ratio of the number of the bipolar transistor Q5 forming the second series circuit to the number of the bipolar transistor Q6 forming the third series circuit is set to 1:4. In the present invention, however, the ratio of the number of transistors is not limited to the number described in this embodiment and can be set arbitrarily.

The band-gap reference voltage circuit of this embodiment is the same as a conventionally known constant-voltage circuit in principle of operation. That is, the voltage of the collector terminal of the bipolar transistor Q5 forming the second series circuit and the voltage of one end of the resistor R12 forming the third series circuit are applied to the gate of the MOS transistor M26 and that of the MOS transistor M11 of the amplifier circuit, respectively, to compare both the voltages, so that the current $I_{C(Q5)}$ of the second series circuit and the current $I_{C(Q6)}$ of the third series circuit are controlled to have the same constant current.

The ratio of the number (shown as "m" in FIG. 5) of the transistors Q5 of the second series circuit to that of the transistors Q6 of the third transistor is set to 1:4 in this embodiment. Therefore, the current $I_{C(Q6)}$ flowing through the third series circuit is formulated with the following equation.

$$I_{C(Q6)}=(V_T \ln 4)/R12$$

where "$V_T$" is a thermal voltage (kT/q), "k" is a Boltzmann constant, "T" is an absolute temperature, and "q" is a unit charge of electron.

Therefore, a current with the same value as the current specified by $I_{C(Q11)}=(V_T \ln 4)/R12$ flows through the fourth series circuit.

FIG. 6 shows an improvement of the band-gap reference voltage circuit shown in FIG. 5, in which the PSRR (Power Supply Rejection Ratio) is improved. The differential amplifier circuit in the improved band-gap reference voltage circuit shown in FIG. 6 also includes an Op-Amp. In this circuit, bipolar transistors Q7 and Q4 are used so that the circuit can be operated even at low power source voltages. The emitter of the bipolar transistor Q7 is connected to the power source voltage terminal Vcc and the collector thereof is connected to the sources of MOS transistors M11 and M26. The drain of the MOS transistor M11 and the drain of the MOS transistor M26 are connected to the drain of the MOS transistor M12 and the drain of the diode-connected M1, respectively. These MOS transistors M12 and M1 are connected at their bases to form a current mirror circuit. The sources of the MOS transistors M12 and M1 are grounded.

Figure 8:
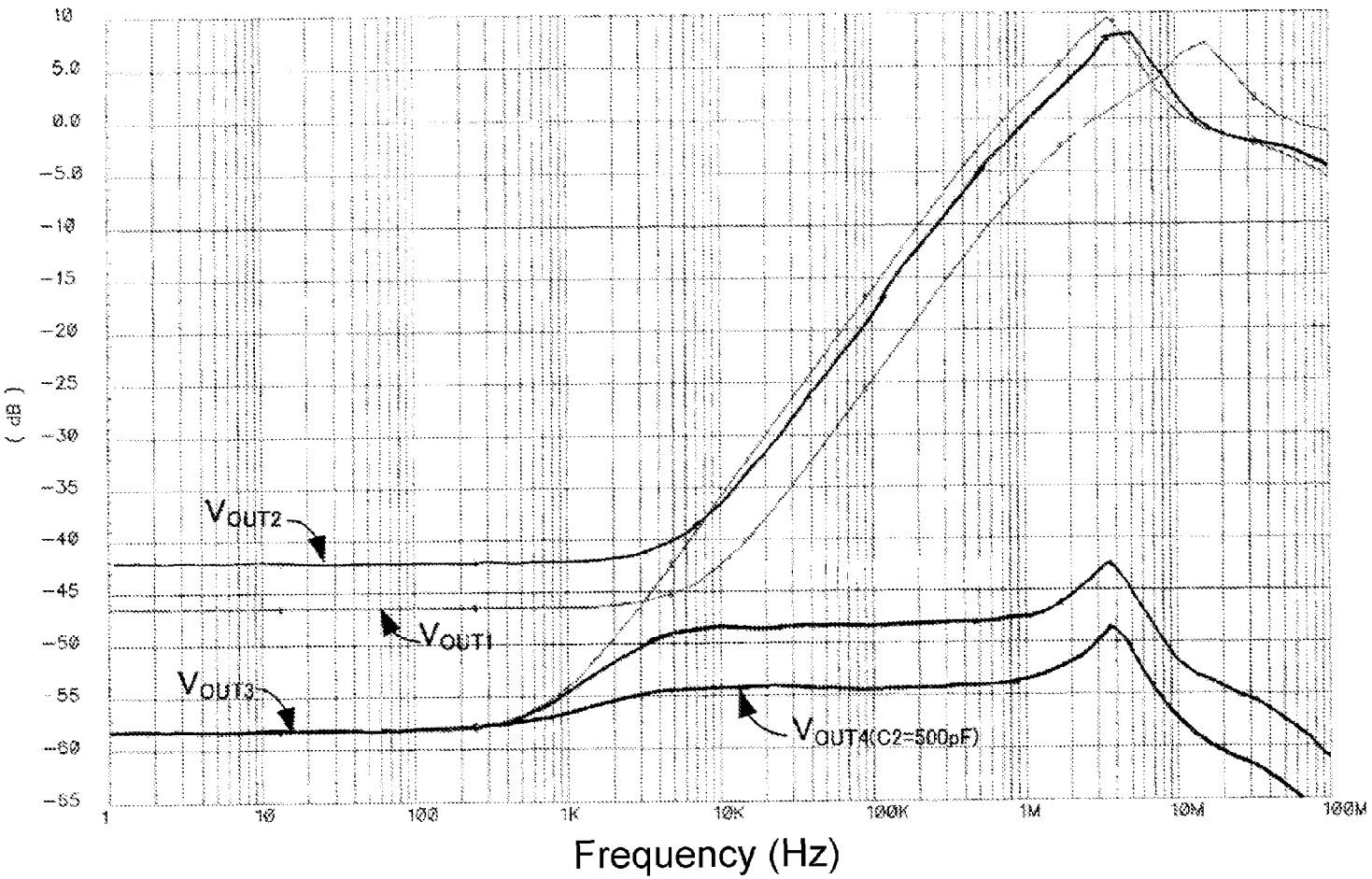
FIG. 8 is a frequency characteristic graph of each of the band-gap reference voltage circuits.

On the right side of the differential amplifier circuit, the same first to fourth band-gap reference voltage circuits as those of the band-gap reference voltage circuit shown in FIG. 5 are provided, and therefore the explanation will be omitted by allotting the same reference numerals to the corresponding portions. In the band-gap reference voltage circuit shown in FIG. 5, a bias current occurs in accordance with the power supply voltage Vcc and the resistor R18. Therefore, fluctuations of the power supply voltage cause fluctuations of the bias current. This also causes fluctuations of the voltage of the commonly connected sources of the MOS transistors M11 and M26 forming the differential circuit. Consequently, common-mode voltage changes are applied to the gates of the MOS transistors M11 and M26, but the differential amplifier portion functions to cancel the common-mode signals, resulting in less effects (at the portion not larger than 1 kHz in the wavelength characteristic graph in FIG. 8). The value, however, depends on the characteristics of the CMRR (Common Mode Rejection Ratio) of the Op-Amp circuit used. This is the reason that PSRR deteriorates at the high frequency side. On the other hand, in the circuit shown in FIG. 6, its own constant current output is used as the bias current of the differential amplifier portion. This decreases the voltage fluctuations of the commonly connected sources of the MOS transistors M11 and M26 in the differential circuit, which improves the PSRR even with the same amplifier structure. As to the frequency characteristics at the high frequency side, by simply adding a bypass condenser C2 as shown in FIG. 7, the PSRR of the output voltage Vout4 is improved and desirable frequency characteristics can be obtained as shown in the frequency characteristic graph of FIG. 8. Therefore, it is important to improve the PSRR at the low frequency side.

Frequency characteristics of three types of the band-gap reference voltage circuits explained above are shown in FIG. 8. As seen clearly in this graph, the circuit shown in FIGS. 6 and 7 is most improved in PSRR and has excellent characteristics.

Returning to FIG. 1, in the low-voltage operation constant-voltage circuit of this embodiment, for the purpose of operating the circuit with minute currents, the bipolar transistors Q7, Q4, Q1, Q0, and Q2 forming the band-gap reference voltage circuit shown in FIG. 6 are replaced with MOS transistors M3, M4, M5, M6, and M7 to provide a constant-voltage circuit exclusively for a reset circuit. Furthermore, to reduce the current flowing through each of the transistors M3, M4, M5, M6, and M7, the ratio of the number of diode-connected bipolar transistors Q5 connected in parallel to the number of diode-connected bipolar transistors Q6 connected in parallel is changed from 1:4 to 1:2, and the value of the resistor R12 is changed from 8 KΩ to 300 KΩ.

Next, the low-voltage operation constant-voltage circuit as shown in FIG. 1 will be explained in detail. As show in FIG. 1, this constant-voltage circuit is equipped with an amplifier circuit on the left and first to fourth series circuits on its right.

The abovementioned amplifier circuit includes an Op-Amp and MOS transistors M3, M11, M26, M12, and M1. The source of the MOS transistor M3 is connected to the power supply voltage terminal Vcc, and the drain thereof is connected to the commonly connected sources of MOS transistors M11 and M26. The drain of the MOS transistor M11 and the drain of the MOS transistor M26 are connected to the drain of the MOS transistor M12 and the drain of the diode-connected MOS transistor M1, respectively. These MOS transistors M12 and M1 are connected at their bases to form a current mirror circuit. The sources of the MOS transistors M12 and M1 are grounded.

Provided on the right side of the amplifier circuit are a first series circuit in which a MOS transistor M4 and a MOS transistor M2 are connected in series, a second series circuit in which a MOS transistor M5 and a diode-connected bipolar transistor Q5 are connected in series, a third series circuit in which a MOS transistor M6, a resistor R12 and a diode-connected bipolar transistor Q6 are connected in series, and a fourth series circuit in which a MOS transistor M7 and a diode-connected MOS transistor M19 are connected in series. In FIG. 1, "m" denotes the number of transistors connected in parallel with each other.

In the embodiment, the ratio of the number of bipolar transistors Q5 forming the second series circuit to the number of bipolar transistors Q6 forming the third series circuit is set to 1:2. In the present invention, however, the ratio of the number of transistors is not limited to the number of this embodiment, and can be set arbitrarily.

In the first series circuit, the MOS transistor M4 is a diode-connected MOS transistor, and the source thereof is connected to the power supply voltage terminal Vcc, the drain thereof is connected to the drain of the MOS transistor M2. The source of the transistor M2 is grounded. The drain of the MOS transistor M2 and the gate thereof is connected via a resistor R0 and a condenser C0.

The MOS transistor M3 of the amplifier circuit and the MOS transistor M4 of the first series circuit are connected at their bases to form a current mirror circuit. Further, the gate of the MOS transistor M11 and the gate of the MOS transistor M26 are connected to one end of the resistor R12 forming the third series circuit and the collector of the diode-connected bipolar transistor Q5 forming the second circuit, respectively. Furthermore, the drain of the MOS transistor M12 forming the amplifier circuit is connected to the gate of the MOS transistor M2 forming the first series circuit.

In the first series circuit, the source of the MOS transistor M4 is connected to the power supply voltage terminal Vcc, and the drain thereof is connected to the drain of the MOS transistor M2. The source of the MOS transistor M12 is grounded.

In the second series circuit, the source of the MOS transistor M5 is connected to the power supply voltage terminal Vcc, and the drain thereof is connected to the collector of the diode-connected bipolar transistor Q5. The emitter of the transistor Q5 is grounded.

In the third series circuit, the source of the MOS transistor M6 is connected to the power supply voltage terminal Vcc, and the drain thereof is connected to one end of the resistor R12. The other end of the resistor R12 is connected to the collector of the diode-connected bipolar transistor Q6, and the emitter of the transistor Q6 is grounded.

In the fourth series circuit, the source of the MOS transistor M7 is connected to the power supply voltage terminal Vcc, and the drain thereof is connected to the drain of the diode-connected MOS transistor M19. The source of the MOS transistor M19 is grounded.

The MOS transistor M4 of the first series circuit, the MOS transistor M5 of the second series circuit, the MOS transistor M6 of the third series circuit, and the MOS transistor M7 of the fourth series circuit are connected at their gates.

In the meantime, in a conventional band-gap reference voltage circuit, using a series circuit in which a resistor and a diode-connected bipolar transistor are connected, the circuit is configured to cancel the positive temperature characteristic of the voltage appeared at both ends of the resistor and the negative temperature characteristic of the base-emitter voltage of the transistor to thereby obtain a stable output voltage having a zero temperature coefficient regardless of the temperature fluctuations. However, since the base-emitter voltage $V_{BE}$ is about 0.6 V, only an output voltage of about 1.2 V can be extracted. Therefore, there is a drawback that the circuit cannot be used for a product which requires a reference voltage of about 0.6 V, such as, e.g., a reference voltage source of a reset circuit for a micro computer. Thus, in this embodiment according to the present invention, in place of a conventional series circuit in which a resistor and a diode-connected bipolar transistor are connected in series, as mentioned above, a series circuit including a diode-connected MOS transistor M19 is employed. As a result, a constant-voltage output excellent in temperature characteristics can be obtained regardless of a low-voltage of about 0.6 V.

In this constant-voltage circuit according to this embodiment, the circuit has the same structure as in a conventionally known constant-current circuit except for the fourth series circuit, and therefore has the same principle. In details, the voltage of the drain terminal of the MOS transistor M5 forming the second series circuit and the voltage of one end of the resistor R12 forming the third series circuit are applied to the gate of the MOS transistor M26 of the amplifier circuit and the gate of the MOS transistor M11 thereof, respectively, to be compared, and controlled so that the current $I_{C(Q5)}$ of the second series circuit and the current $I_{C(Q6)}$ of the third series circuit become the same constant value.

In this embodiment, the ratio of the number of the transistors Q5 forming the second series circuit to the number of the transistors Q6 forming the third series circuit is set to 1:2 for the purpose of reducing the currents, and therefore, the current $I_{C(Q6)}$ flowing through the third series circuit can be obtained with the following equation:

$$I_{C(Q6)}=(V_T \ln 2)/\mathrm{R12}$$

where "$V_T$" is a thermal voltage (kT/q), "k" is a Boltzmann constant, "T" is an absolute temperature, and "q" is a unit charge of electron.

Specifically, this embodiment employs a resistor R12 of 300 KΩ. Accordingly, from the above equation:

$$I_{C(Q6)} = (V_T \ln 2)/R12$$

$$= [1.3807E-23 \times 300.15 \div 1.6021892E-19) \times$$

-continued $$0.693147181]/R12(27\text{ degrees})$$

$$= (5.97307E-05 \times T) \div R12$$

$$= 1.7928E-02 \div R12$$

$$\approx 0.059760589\text{ (micro } A)$$

That is, $I_{C(Q6)}$ becomes about 60 nA.

In the circuit according to this embodiment, a current of the same value flows through each of the MOS transistors M3 to M7, and therefore, a current of 300 nA, five times of the aforementioned current value, is the consumption current for the entire circuit. Therefore, the circuit can be suitably used for a reset circuit loose in voltage rating and sever in power source voltage requirements.

Figure 2:
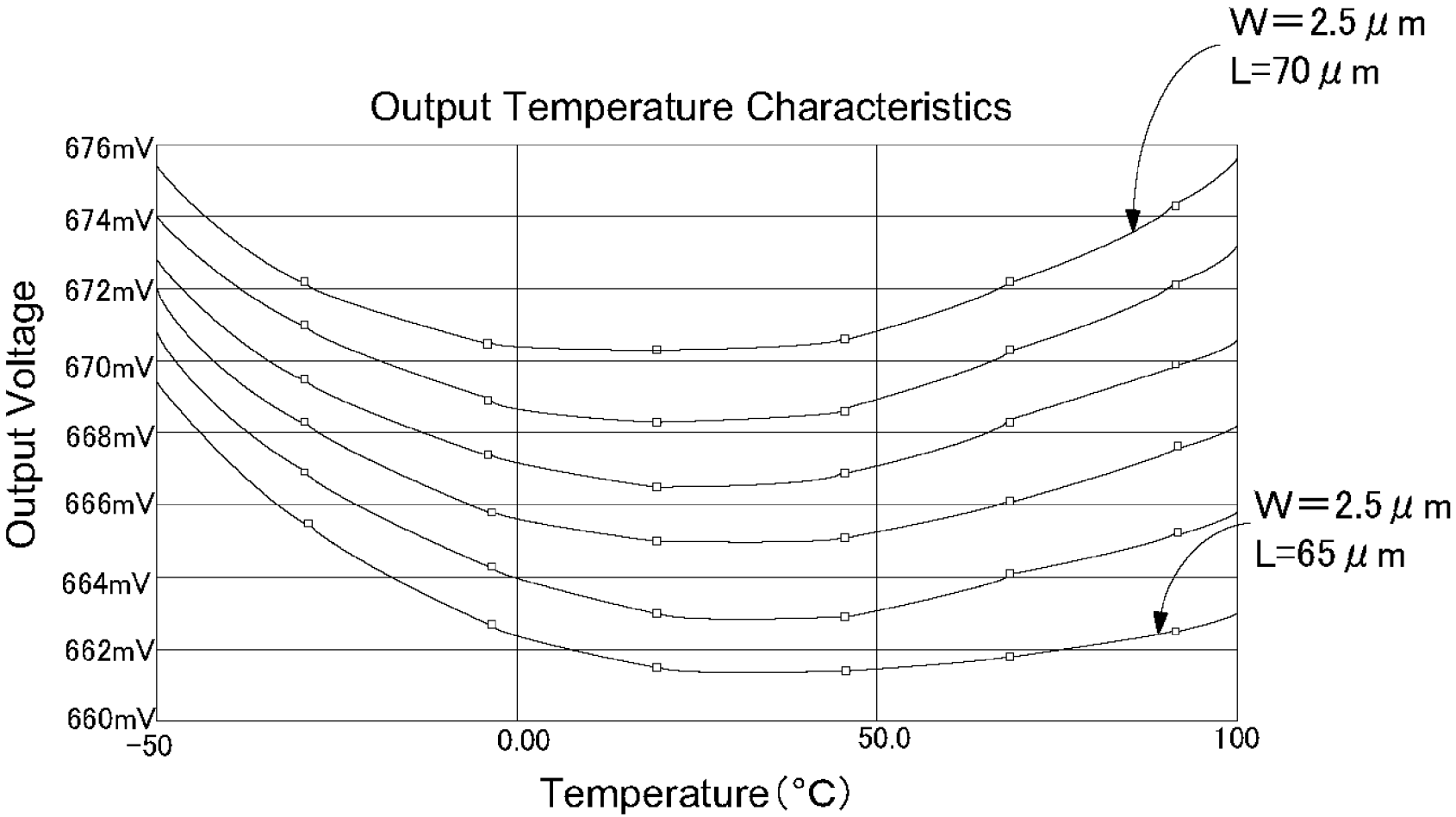
FIG. 2 is an output temperature characteristic graph of the low-voltage operation constant-voltage circuit according to the first embodiment of the present invention.

A current of the same value as specified by $I_{C(Q6)}=(V_T \ln 2)/R12$ flows through the fourth series circuit. Now, the temperature characteristics of the diode-connected MOS transistor M19 forming the fourth series circuit specific to the present constant-voltage circuit varies according to the ratio of the width W of the transistor to the length L thereof. FIG. 2 shows the temperature characteristic changes when the width W and the length L of the transistor M19 are changed. In FIG. 2, the uppermost curved line is an output temperature characteristic curve when the width W of the MOS transistor M19 is 2.5 μm and the length L there of is 70 μm, and the lowermost curved line is an output temperature characteristic curve when the width W the MOS transistor M19 is 2.5 μm and the length L thereof is 65 μm. By changing the width W and the length L arbitrarily, a constant-voltage, which is practically sufficient in a specified temperature range, can be extracted. Therefore, by setting the most appropriate ratio of the width W to the length L according to its use, a low-voltage constant-output voltage having desired temperature characteristics can be obtained.

Second Embodiment

Figure 9:
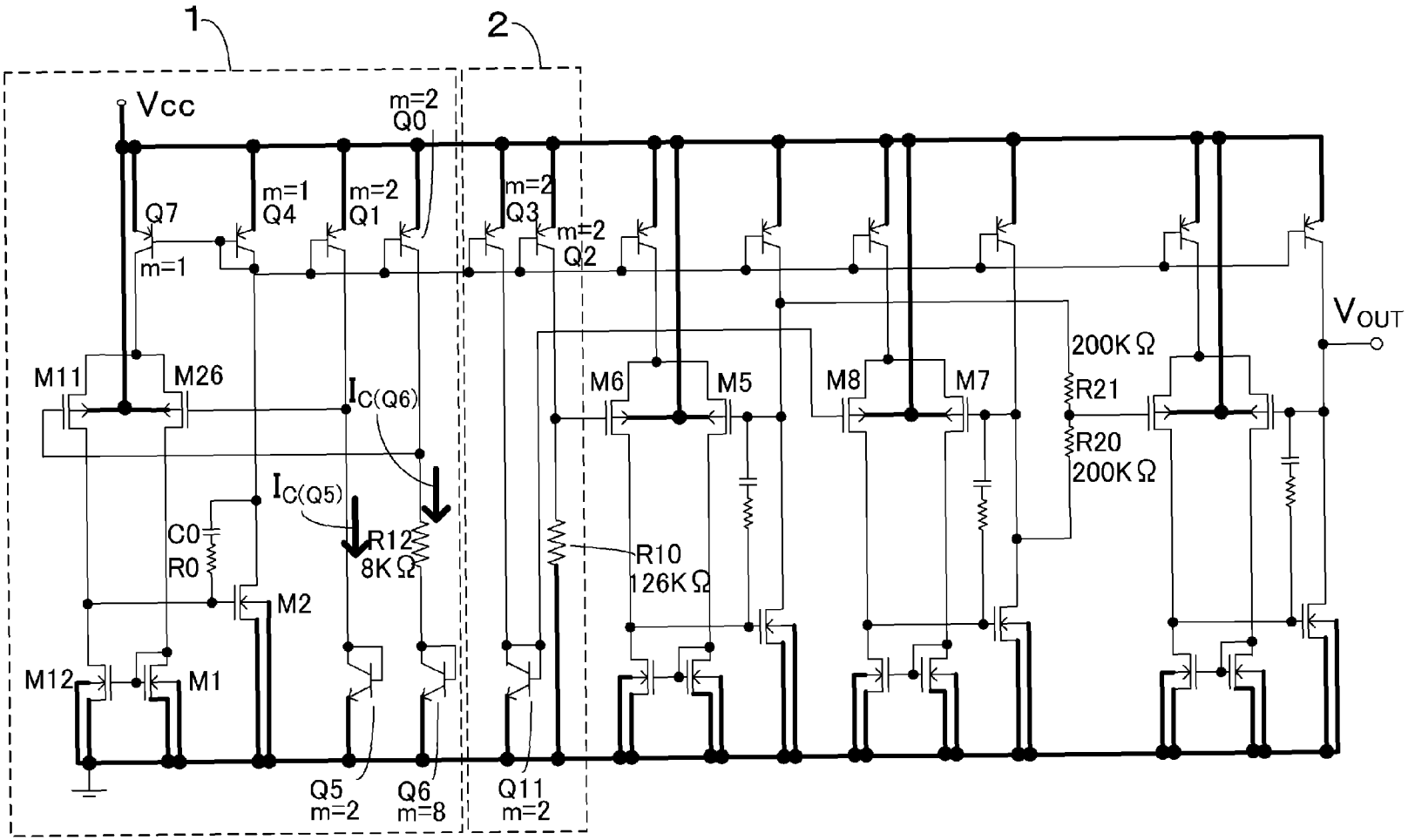
FIG. 9 is a circuit diagram of a low-voltage operation constant-voltage circuit according to a second embodiment of the present invention.

FIG. 9 shows a low-voltage operation constant-voltage circuit according to a second embodiment of the present invention. The constant-voltage circuit includes an Op-Amp style band-gap reference voltage circuit 1 as its basic component circuit, and is a constant-voltage circuit excellent in temperature characteristics and configured to output a stable output voltage which is a low-voltage of about 0.6 V from its output terminal $V_{OUT}$ regardless of the ambient temperature changes. This circuit can be suitably used as a constant-voltage power source for minute currents, such as, e.g., a reference voltage source for reset circuit of microcomputers. The constant-voltage circuit includes a differential circuit which compares the voltages by transistors M11 and M26 to equalize the collector current $I_{C(Q5)}$ of the transistor Q5 and collector current $I_{C(Q6)}$ of transistor Q6 to thereby provide a current from a current mirror circuit formed by the transistors M12 and M1.

As shown in the portion 1 surrounded by the dashed lines on the left side of FIG. 9, the low-voltage operation constant-voltage circuit according to this embodiment includes a band-gap reference voltage circuit 1 as its basic component circuit. In the low-voltage operation constant-voltage circuit according to the present invention, the specific structure of the band-gap reference voltage circuit portion is not specifically limited, and can be, for example, a circuit employing bipolar transistors as shown in FIG. 3, an Op-Amp type band-gap reference voltage circuit shown in FIGS. 5 to 7, and other various conventionally known band-gap reference voltage circuits.

The low-voltage operation constant-voltage circuit according to this embodiment employs the band-gap reference voltage circuits shown in FIG. 7 in which the PSRR is most improved among the abovementioned band-gap reference voltage circuits. Therefore, the explanation will be omitted by simply allotting the same reference numeral to the corresponding portion.

As shown in the portion 2 surrounded by the dashed lines in FIG. 9, in this circuit, the series circuit including the resistor R10 and the diode-connected bipolar transistor Q11 of the band-gap reference voltage circuit shown in FIG. 6 is separated into a series circuit including a bipolar transistor Q3 and a diode-connected bipolar transistor Q11, and a series circuit including a bipolar transistor Q2 and a resistor R10, and these series circuits are connected in parallel with each other.

In the abovementioned band-gap reference voltage circuit, the base-emitter voltage $V_{BE(Q11)}$ of the bipolar transistor Q11 forming one of the abovementioned series circuits (transistor-diode series circuit) has negative temperature characteristics. On the other hand, a voltage having positive temperature characteristics appears at both ends of the resistor R10 forming the other abovementioned series circuit (transistor-resistor series circuit). In the conventional band-gap reference voltage circuit, by connecting the bipolar transistor Q11 and the resistor R10 in series, a voltage having a positive temperature characteristic appeared at both ends of the resistor R10 and a base-emitter voltage $V_{BE(Q11)}$ of the transistor Q11 having a negative temperature characteristic are cancelled, which makes it possible to obtain a stable output voltage having a zero temperature coefficient regardless of the ambient temperature changes. However, since the base-emitter voltage $V_{BE(Q11)}$ of the transistor Q11 is about 0.6 V, only an output voltage of about 1.2 V can be extracted. Thus, in this embodiment according to the present invention, as mentioned above, in place of the series circuit including a resistor and a diode-connected bipolar transistor connected in series, the bipolar transistor Q11 and the resistor R10 are separated into two series circuits, one including the bipolar transistor Q11 and the other including the resistor R10, and the voltage of the collector of the bipolar transistor Q11 and the voltage of one end of the resistor R10 are extracted separately. From these voltages, a midpoint voltage of these voltages is created by two resistors R21 and R20 connected in series, each having the same resistance value (200 KΩ in this embodiment). Then, the created midpoint voltage is buffered and extracted outside. As a result, a constant-voltage output excellent in temperature characteristics and low in voltage of about 0.6 V can be obtained.

The abovementioned band-gap reference voltage circuit of this embodiment has the same principles as in conventionally known circuits. That is, the voltage of the collector terminal of the bipolar transistor Q5 and the voltage of one end of the resistor R12 are applied to the gate of the MOS transistor M26 of the amplifier circuit and the gate of the MOS transistor M11 thereof to be compared, and controlled so that the current $I_{C(Q5)}$ and the current $I_{C(Q6)}$ become a constant current of the same value.

In this embodiment, the ratio of the number (the number is shown as "m" in FIG. 9) of the transistors Q5 to the number of the transistors Q6 is set to 1:4, and therefore, the current $I_{C(Q6)}$ flowing through the transistors Q6 can be obtained by the following equation:

$$I_{C(Q6)}=(V_T \ln 2)/R12$$

where "$V_T$" is a thermal voltage (kT/q), "k: is a Boltzmann constant, "T" is an absolute temperature, and "q" is a unit charge of electron.

Accordingly, the same current as specified by $I_{C(Q11)}=(V_T \ln 4)/R12$ also flows through the transistor Q11.

Figure 10:
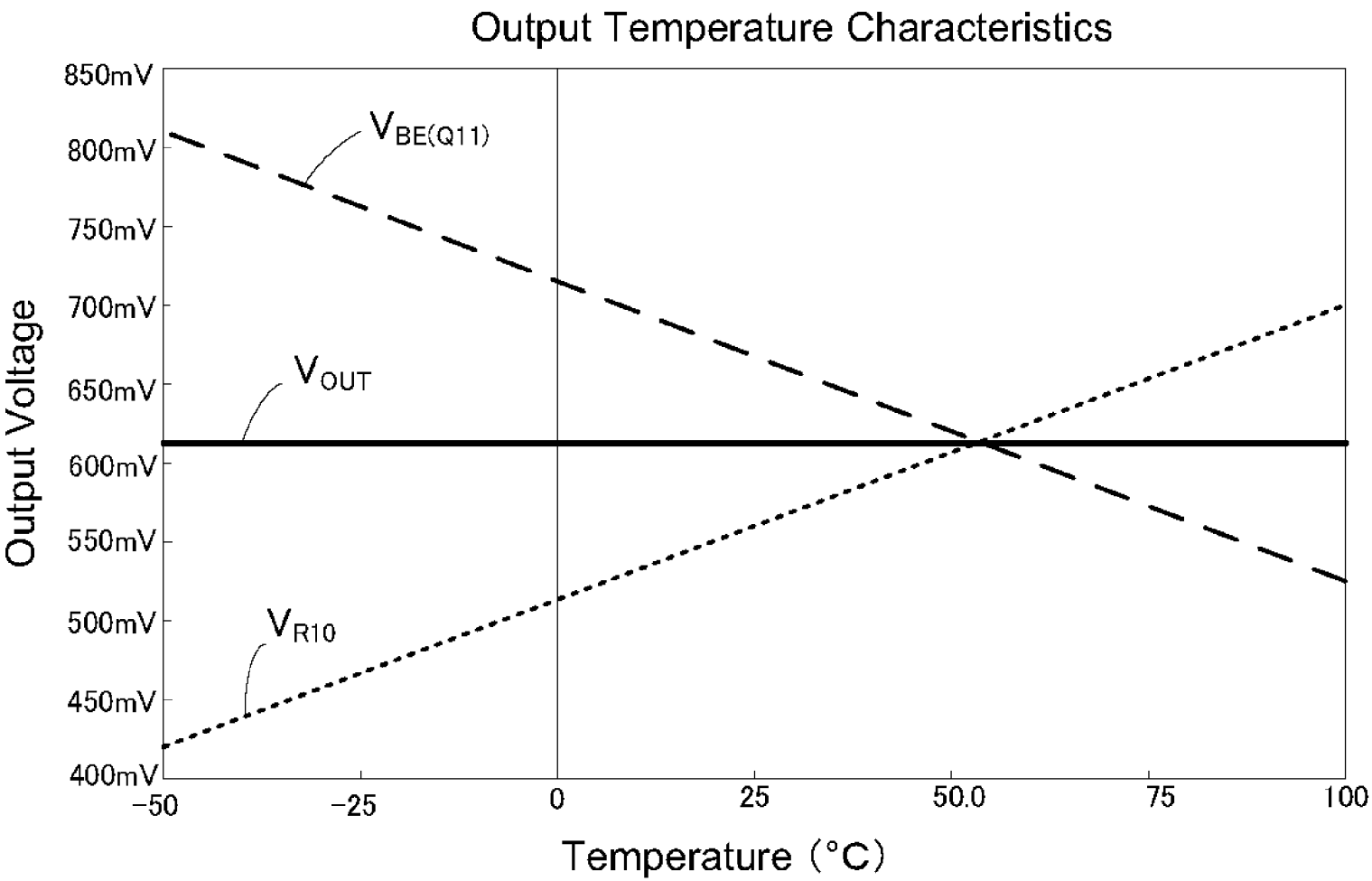
FIG. 10 is an output temperature characteristic graph of the low-voltage operation constant-voltage circuit according to the second embodiment of the present invention.

On the right side of the band-gap reference voltage circuit, three Op-Amps, the aforementioned resistors R21 and R20 for creating the midpoint voltage are provided. That is, MOS transistors M6 and M5 constitute a differential circuit, and the circuit is formed by a first Op-Amp. Similarly, the differential circuit is formed by MOS transistors M8 and M7, and the circuit is formed by a second Op-Amp. The voltage of one end of the resistor R10 is applied to one end of the resistors R21 and R20 connected in series through the first Op-Amp, while the base-emitter voltage of the bipolar transistor Q11 is applied to the other end of the resistors R21 and R20 connected in series through the second Op-Amp. That is, as shown in FIG. 10, the base-emitter voltage $V_{BE(Q11)}$ of the bipolar transistor Q11 shows negative temperature characteristics, whereas the voltage $V_{R10}$ of the terminal of the resistor R10 shows positive temperature characteristics. By superimposing these voltages, an output voltage $V_{OUT}$ having a zero temperature coefficient can be obtained.

As described above, in a conventional band-gap reference voltage circuit, since the base-emitter voltage $V_{BE(Q11)}$ of a transistor is about 0.6 V, and therefore only an output voltage of about 1.2 V can be extracted. In this embodiment according to the present invention, however, in place of the series circuit including a resistor and a diode-connected bipolar transistor connected in series, the bipolar transistor and the resistor are separated into two series circuits, one including the bipolar transistor Q11 and the other including the resistor R10, and the voltage of the collector of the bipolar transistor Q11 and the voltage of one end of the resistor R10 are extracted separately. From these voltages, a midpoint voltage of these voltages is created by two resistors R21 and R20 connected in series. Then, the created midpoint voltage is buffered by the third Op-Amp and extracted outside. As a result, a low voltage of about 0.6 V can be obtained. Further, a constant-voltage output excellent in temperature characteristics with almost zero temperature characteristic can be obtained.

Figure 11:
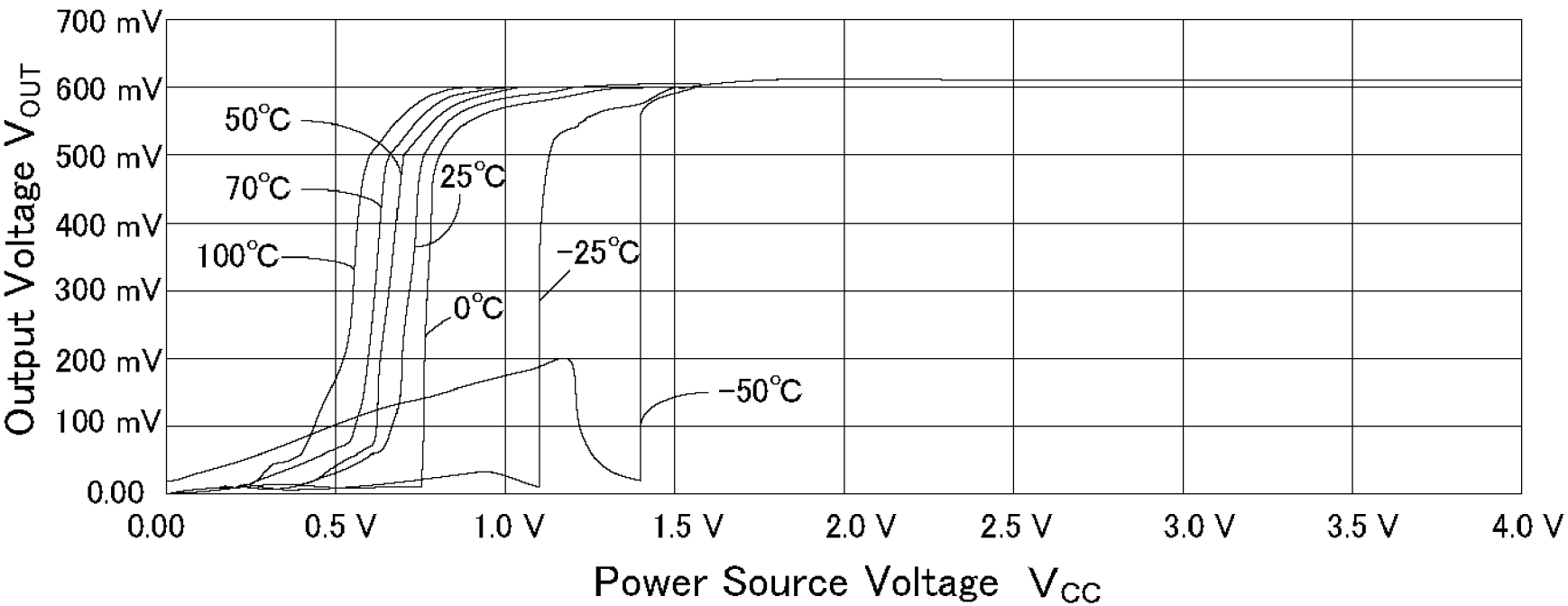
FIG. 11 is a graph showing the relationship between the power source voltage and the output voltage.
Figure 12:
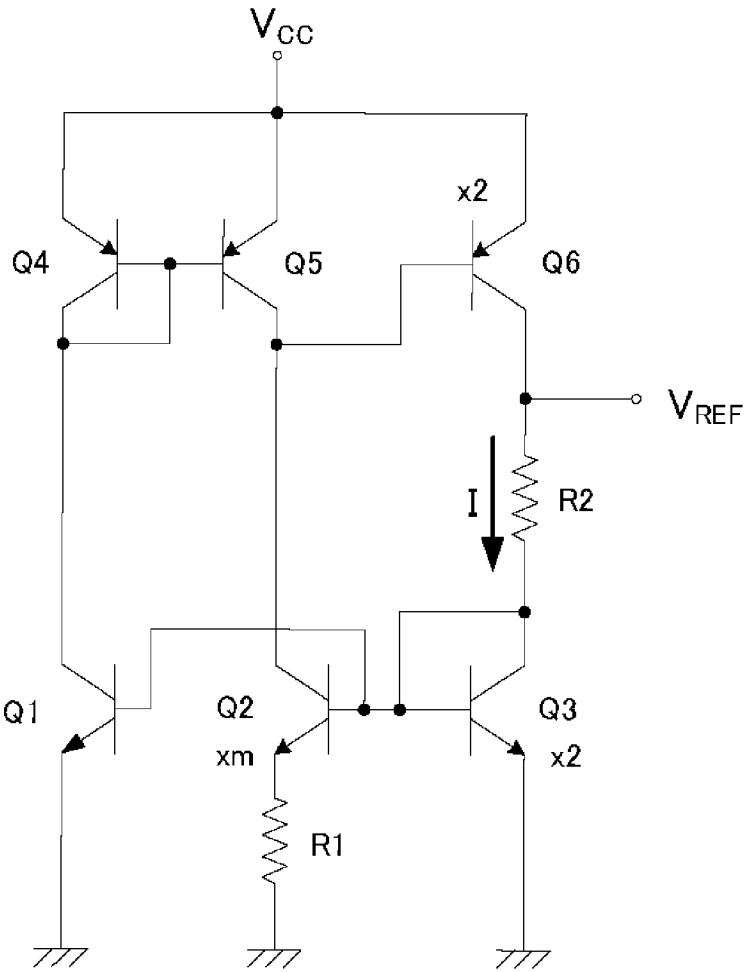
FIG. 12 (Prior Art)
FIG. 12 is a circuit diagram of a conventionally known band-gap reference voltage circuit.

The relationship between the power supply voltage $V_{CC}$ and the output voltage $V_{OUT}$ of the constant-voltage circuit of the embodiment was examined while changing the ambient temperature. The results are shown in FIG. 11. From these results, it is confirmed that a constant voltage of about 0.6 V can be obtained when the power supply voltage is 1.5 V or above regardless of the ambient temperatures. Also, when the ambient temperature is near normal temperature, a stable voltage can be obtained with a power supply voltage of 1.0 V or above. In this manner, according to the constant-voltage circuit of this embodiment, a stable and low output voltage can be obtained.

BROAD SCOPE OF THE INVENTION

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" is meant as an non-specific, general reference and may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

What is claimed is:

1. A low-voltage operation constant-voltage circuit, comprising:

a band-gap reference voltage circuit having a resistor-diode series circuit as a main component in which a resistor and a diode-connected bipolar transistor are connected in series to create a constant current, one end of the resistor-diode series circuit being grounded; and an output circuit connected in parallel to the resistor-diode series circuit and configured so that a current flowing through the output circuit becomes equal to the constant current flowing through the resistor-diode series circuit, one end of the output circuit being grounded, wherein the output circuit includes a diode-connected MOS transistor configured to cancel a positive temperature coefficient of the current flowing through the output circuit and an output terminal connected to a drain terminal of the diode-connected MOS transistor to output a reference voltage as a low reference voltage source for an external device, and wherein the diode-connected MOS transistor within the output circuit has a desired temperature characteristic specified by a set ratio of a width W of the diode-connected MOS transistor to a length L thereof, the set ratio (W/L) being within a range from 2.5/70 to 2.5/65.

2. A low-voltage operation constant-voltage circuit, comprising:

a band-gap reference voltage circuit including a first series circuit in which a first MOS transistor and a diode-connected first bipolar transistor are connected in series and a second series circuit in which a second MOS transistor, a resistor and a diode-connected second bipolar transistor are connected in series, wherein the band-gap reference voltage circuit is configured to compare a collector voltage of the first bipolar transistor of the first series circuit and the voltage of one end of the resistor of the second series circuit and control so that a current of the first series circuit and a current of the second series circuit become equal, one end of the band-gap reference voltage circuit being grounded; and an output circuit in which a third MOS transistor and a diode-connected fourth MOS transistor are connected in series, wherein the output circuit is connected in parallel to the first series circuit and the second series circuits and controlled so that a current flowing through the output circuit becomes equal to the current flowing through the first series circuit and the current flowing through the second series circuit, one end of the output circuit being grounded, wherein the output circuit is configured to output a reference voltage as a low reference voltage source for an external device from a connection point of the third and fourth MOS transistors, and wherein the diode-connected fourth MOS transistor within the output circuit has a desired temperature characteristic specified by a set ratio of a width W of the diode-connected fourth MOS transistor to a length L thereof, the set ratio (W/L) being within the range from 2.5/70 to 2.5/65.

3. The low-voltage operation constant-voltage circuit as recited in claim 2, wherein the first bipolar transistor within the first series circuit is constituted by a plurality of bipolar transistors connected in parallel and the second bipolar transistor within the second series circuit is constituted by another plurality of bipolar transistors connected in parallel, and wherein the number of bipolar transistors constituting the first bipolar transistor and the number of bipolar transistors constituting the second bipolar transistor are different.

* * * * *